US012193549B2

(12) United States Patent
Hynecek

(10) Patent No.: US 12,193,549 B2
(45) Date of Patent: Jan. 14, 2025

(54) DEPLOYABLE SUPPORT APPARATUS

(71) Applicant: Speculative Product Design, LLC, San Mateo, CA (US)

(72) Inventor: Bryan Hynecek, Redwood City, CA (US)

(73) Assignee: Speculative Product Design, LLC, San Mateo, CA (US)

( * ) Notice: Subject to any disclaimer, the term of this patent is extended or adjusted under 35 U.S.C. 154(b) by 0 days.

(21) Appl. No.: 18/418,445

(22) Filed: Jan. 22, 2024

(65) Prior Publication Data

US 2024/0206609 A1 Jun. 27, 2024

Related U.S. Application Data

(62) Division of application No. 18/085,650, filed on Dec. 21, 2022, now Pat. No. 11,877,634.

(51) Int. Cl.
*A45C 11/00* (2006.01)

(52) U.S. Cl.
CPC ..... *A45C 11/00* (2013.01); *A45C 2011/003* (2013.01); *A45C 2200/15* (2013.01)

(58) Field of Classification Search
CPC ..... A45C 11/00; A45C 2011/003; A45C 2200/15; A45C 2011/002; A45C 13/002; A45C 2013/025; F16M 22/00
USPC ..... 206/320, 45.2, 45.24, 45.26; 248/688, 248/683, 579, 441.1, 447, 454, 121, 126, 248/127
See application file for complete search history.

(56) References Cited

U.S. PATENT DOCUMENTS

| | | | | |
|---|---|---|---|---|
| 9,768,822 | B1 * | 9/2017 | Loh | H04M 1/185 |
| 2014/0034080 | A1 * | 2/2014 | Paquet | A45C 13/1069 132/286 |
| 2014/0076748 | A1 * | 3/2014 | Padilla | A45C 11/00 206/45.23 |
| 2014/0332418 | A1 * | 11/2014 | Cheung | H04B 1/3877 206/45.2 |
| 2015/0375894 | A1 * | 12/2015 | Idehara | A45C 11/00 206/45.24 |
| 2016/0088750 | A1 * | 3/2016 | Wu | F16M 11/10 248/688 |
| 2020/0319530 | A1 * | 10/2020 | Vélez Justiniano | G03B 11/041 |
| 2023/0210234 | A1 * | 7/2023 | Cabunoc | A45C 3/02 206/320 |

* cited by examiner

*Primary Examiner* — Rafael A Ortiz
(74) *Attorney, Agent, or Firm* — HILL, KERTSCHER & WHARTON, LLP; Gregory T. Ourada

(57) ABSTRACT

A support having a magnetically assisted deployment and retraction mechanism which is designed for use with protective covers for personal electronic devices such as smartphones and tablet computing devices featuring a segmented support structure that deploys from a first channel when a shuttle located in a second channel disposed under the first channel is moved from a first position to a second position. The shuttle contains a first magnet and a second magnet, and the segmented support contains magnets which generate either attractive or repulsive forces depending on the position of the shuttle, which forces cause deployment of the support.

2 Claims, 7 Drawing Sheets

DEPLOYABLE SUPPORT APPARATUS

BACKGROUND

This disclosure describes embodiments of a rapidly deployable stand for a protective case for an electronic device, e.g. a tablet or smartphone. It is desirable for protective cases to have a deployable stand that is compact yet easy and quick to deploy.

SUMMARY

The preferred embodiments describe a substantially flat chassis that can be easily incorporated into the structure of a protective case for a personal electronic device such as a tablet or smartphone. The chassis in such embodiments incorporates two intersecting channels: an upper channel and a lower channel. In certain embodiments, these channels are disposed orthogonally, such that the bottom of the upper channel and the top of the lower channel are coincident at the intersection of the two channels. The upper channel accommodates the deployable stand, which is typically comprised of a plurality of hinged flat panels. In one particular embodiment, the deployable stand comprises an upper panel, a middle panel, and a lower panel. Each adjacent panel is connected by a hinge. In most embodiments, the hinge is a flat sheet of flexible material, although conventional knuckle-and-pin hinges might also be used. The upper panel in such embodiment has two side tabs which extend into and are constrained to translate linearly (e.g. slide) in a side tab channel. The middle panel incorporates at least two magnets, which have an opposing orientation, i.e., one magnet is oriented north-south, while the second magnet is oriented south-north. The lower panel is connected at a top edge to the bottom edge of the adjacent middle panel, and is hingedly connected to the lower edge of the upper channel at its bottom edge. In this embodiment, the upper panel of the deployable stand is constrained to slide linearly within the upper channel by its side tabs. However, the middle panel and lower panel are only hingedly attached to adjacent panels at their top and bottom edges, and are free to displace upwardly and out of the upper channel.

This particular embodiment also features a lower channel disposed within the chassis below the upper channel. The lower channel accommodates a shuttle which is constrained to translate linearly (e.g. slide back and forth) in the lower channel. The shuttle is operated by a shuttle actuating lever which extends upwardly from the chassis through an actuating lever slot. The shuttle actuating lever is disposed at one end of the long axis of the shuttle; the opposing end of the shuttle is attached to a spring. The shuttle itself in this embodiment incorporates two magnets which correspond to each of the magnets disposed in the middle panel of the deployable stand. In a first position, the two magnets in the middle panel of the deployable stand are superimposed above those located in the shuttle. In this first position, the magnets in the shuttle have the same polar orientation from those in the middle panel, e.g., a magnet oriented north-south in the middle panel is disposed in a first position directly above a magnet in the shuttle oriented north-south such that the two pairs of magnets attract each other. However, when the shuttle is moved to a second position using the shuttle actuating lever, a second magnet having an opposite magnetic alignment is brought into proximity directly below the magnet located in middle panel so that in the second position the magnets exert a repulsive force in the second position, i.e. the magnet in the middle panel is oriented north-south, and the magnet in the shuttle in the second position is oriented south-north. This repulsive magnetic force caused when the shuttle is placed in the second position causes the middle panel to translate upwardly and out of the upper channel. The upper panel, being both attached to the middle panel and constrained to translate linearly in the upper channel, translates downwardly as a result. When the shuttle actuating lever is released, the spring attached to the opposite end of the shuttle as the shuttle actuating lever exerts a force causing the shuttle to return to the first position. In the shuttle's first position, the magnet which was displaced in the second position returns to its original position, where it exerts an attractive force on the magnet located in the upper panel. This results in the upper panel sliding into a locked position, which also corresponds to the support being fully deployed.

Another embodiment of the deployable stand incorporates an extra pair of magnets (one magnet located in the shuttle, and the other located in the middle panel). Other embodiments may replace the magnet located in the upper panel with a plate of ferrous material (i.e. a temporary, as opposed to a permanent, magnet). This may be done to reduce cost or where it may be undesirable to have a magnet located in the upper panel (e.g. to reduce electromagnetic interference or to prevent magnetic effects on a memory storage device).

It is one of the objectives of the described embodiments to take advantage of the attractive and repulsive properties of magnets in certain relative orientations in order to provide a motive force to quickly deploy a support for a protective case.

The features of the above-described embodiments are not exclusive to each other, and any one of the features and embodiments can be combined with one or more of the other features and embodiments to arrive at further aspects of the invention.

DETAILED DESCRIPTION OF PREFERRED EMBODIMENTS

Figure 1:
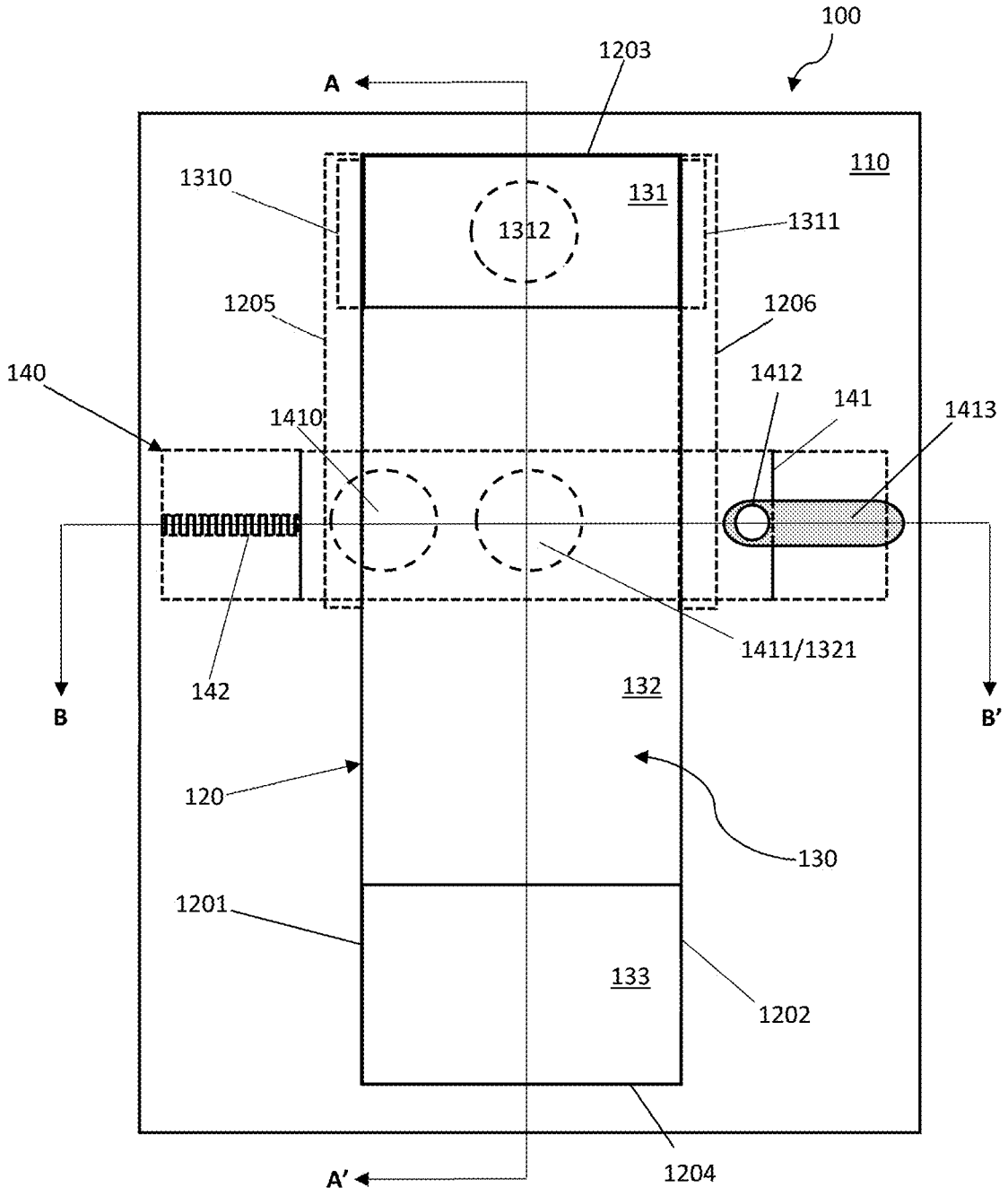
FIG. 1 is a plan view of one embodiment of the deployable stand incorporated into a chassis.

The present invention may be understood more readily by reference to the following detailed description of the invention taken in connection with the accompanying drawing figures, which form a part of this disclosure. It is to be understood that this invention is not limited to the specific devices, methods, conditions, or parameters described and/or shown herein, and that the terminology used herein is for the purpose of describing particular embodiments by way of example only and is not intended to be limiting of the claimed invention.

Also, as used in the specification including the appended claims, the singular forms "a", "an", and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value.

Similarly, when values are expressed as approximations, by use of the antecedent "about", it will be understood that the particular value forms another embodiment.

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well-known in the art, and because they do not facilitate a better understanding of the present invention, a discussion of such elements is not provided herein.

The described features, structures, or characteristics of the invention may be combined in any suitable manner in one or more embodiments. In the following description, numerous specific details are recited to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

It is noted that the terminology used above is for the purpose of reference only, and is not intended to be limiting. For example, terms such as "upper," "lower," "above," "below," "rightward," "leftward," "clockwise," and "counterclockwise" refer to directions in the drawings to which reference is made. As another example, terms such as "inward" and "outward" may refer to directions toward and away from, respectively, the geometric center of the component described. As a further example, terms such as "front," "rear," "side," "left side," "right side," "top," "bottom," "inner," "outer," "horizontal," and "vertical" describe the orientation of portions of the component within a consistent but arbitrary frame of reference which is made clear by reference to the text and the associated drawings describing the component under discussion. Such terminology will include the words specifically mentioned above, derivatives thereof, and words of similar import.

Magnets always have two poles, north (N) and south (S), which define the magnetic orientation of the magnet, i.e. N-S or S-N. The embodiments described herein may refer to the particular magnetic orientation of a magnet or set of magnets. Such magnet or set of magnets will have a defined polar orientation, meaning that the poles of the magnets comprising the set will be oriented N-S or S-N. Magnetic lines of force run from N-S, with the consequence that opposite poles of magnets (i.e. N and S, or S and N) generate maximum attractive forces when brought into proximity, while like poles of magnets (i.e. N and N, or S and S) generate maximum repulsive magnetic forces. These attractive and repulsive forces may be illustrated in the drawings by arrows.

Reference to "magnets" herein can refer to permanent magnets, temporary magnets, or electromagnets. Permanent magnets are comprised of a material (e.g., neodymium) which emits a magnetic field without requiring an external source of magnetism or electricity. Temporary magnets are made of iron or iron alloys (i.e., ferrous alloys). These materials exhibit magnet-like properties while in proximity to a magnetic field emitter such as a permanent magnet or electromagnet. Finally, electromagnets are comprised of materials exhibiting magnetic properties while conducting an electrical current. In the embodiments shown, either permanent or temporary magnets having a thickness of 0.5-1.0 mm will typically be used. The strength of the magnets' magnetic field B (typically expressed in gauss or tesla) is tailored to ensure that the appropriate attractive or repulsive magnetic force is generated without being so strong that undesirable magnetic effects occur, e.g., erasure of magnetic memory or the magnets being too difficult to separate.

While this invention has been described in conjunction with the specific embodiments outlined above, it is evident that many alternatives, modifications, and variations will be apparent to those skilled in the art. Indeed, the disclosure set forth herein includes all possible combinations of the particular features set forth above, whether specifically disclosed herein or not. For example, where a particular feature is disclosed in the context of a particular aspect, arrangement, configuration, or embodiment, that feature can also be used, to the extent possible, in combination with and/or in the context of other particular aspects, arrangements, configurations, and embodiments of the invention, and in the invention generally. Moreover, the disclosure set forth herein includes the mirror image, i.e., mirror configuration, taken from any perspective of any drawing or other configuration shown or described herein. Accordingly, the preferred embodiments of the invention as set forth above are intended to be illustrative, not limiting. Various changes may be made without departing from the spirit and scope of the inventions as defined in the following claims. In addition, it is noted that citation or identification of any document in this application is not an admission that such document is available as prior art to the present invention.

The embodiments disclosed herein generally employ a specific configuration of magnets to effect the deployment and retraction of a support for a manufactured article, e.g. a personal electronic device (smartphone, tablet computer, laptop or other mobile devices whether computing or non-computing), or a protective cover or case for such article.

One such embodiment is illustrated in FIG. 1, which is a plan view of a generic exemplary embodiment of a magnetically deployable support stand 100. Chassis 110 incorporates upper channel 120, which is characterized by two elongated side edges 1201, 1202, an upper edge 1203, and a lower edge 1204. The top of upper channel 120 is flush with the surface of chassis 110, and upper channel 120 also features a flat bottom. An upper portion of the two elongated side edges 1201, 1202 of upper channel 120 also incorporate side tab channels 1205, 1206. Deployable stand 130 is comprised of multiple hinged panels: upper panel 131, middle panel 132, and lower panel 133. Upper panel 131 has side tabs 1310, 1311 extending outwardly from each of its side edges, and these side tabs 1310, 1311 insert into side tab channels 1205, 1206 respectively.

Lower channel 140 in this embodiment is disposed below and perpendicularly to the upper channel within the chassis. Lower channel 140 accommodates shuttle 141, which in this embodiment is an elongated flat strip having two long edges and two short edges. Shuttle 141 incorporates two magnets 1410 and 1411. Each magnet 1410 and 1411 has an opposite magnetic orientation, e.g. 1410 is oriented with north pole upward, south pole downward (N-S), while magnet 1411 is oriented with south pole upward, north pole downward (S-N). Middle panel 132 incorporates a magnet 1321, which is oriented with south pole upward, north pole downward (S-N). Thus, with the shuttle located in the first position shown in FIG. 1, magnets 1411 and 1321 are oriented so that the south pole of magnet 1411 is disposed directly below and in proximity to the north pole of 1321, which results in magnets 1411 and 1321 exerting an attractive force which maintains deployable stand 130 in an undeployed position. Shuttle 141 has a shuttle actuating lever 1412 located at one end. Shuttle actuating lever 1412 slides in shuttle actuating lever slot 1413 in the top surface of chassis 110. Spring 142 is attached at one end to one end of lower channel 140 and at a second end is attached to the end of shuttle 141 opposite the shuttle actuating lever 1412.

Figure 2A:
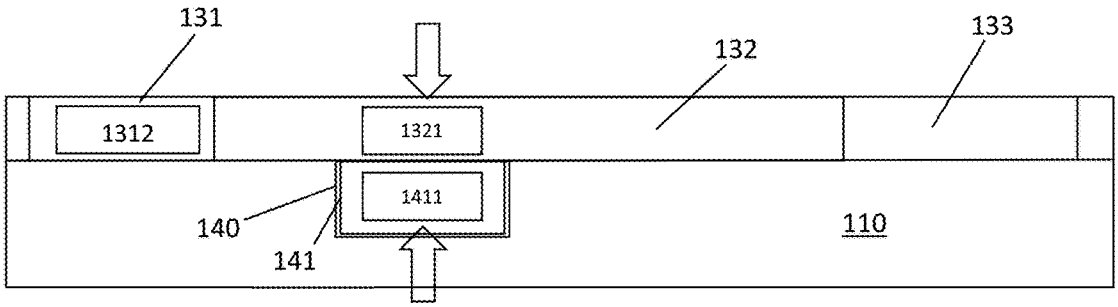
FIG. 2A is an elevation view through A-A' of FIG. 1, showing the magnetic configuration with the shuttle in a first position, where the support is in an initial undeployed position.
Figure 2B:
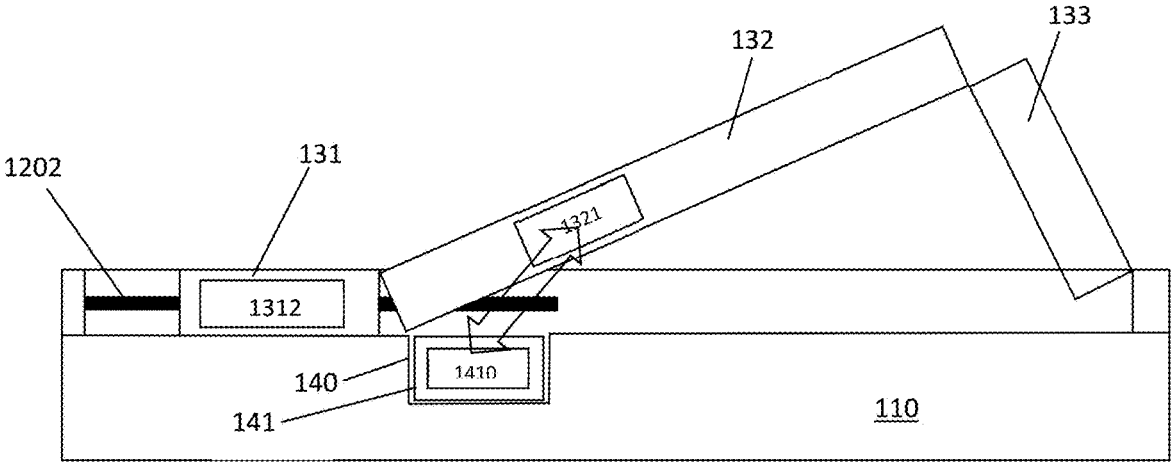
FIG. 2B is an elevation view through A-A' of FIG. 1, showing the magnetic configuration with the shuttle in a second position, where the support is midway through deployment.
Figure 2C:
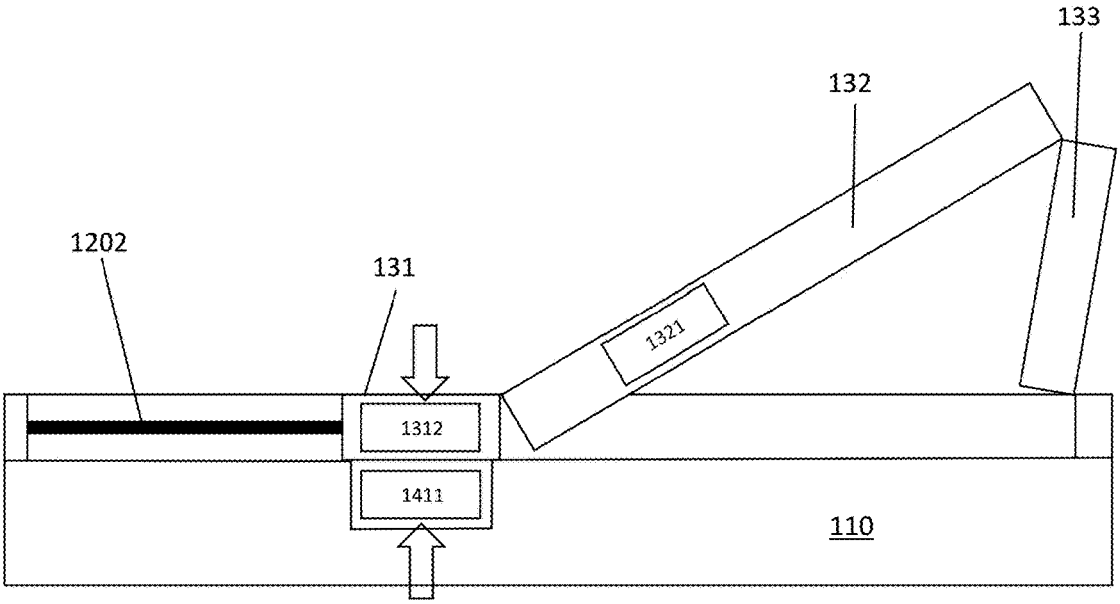
FIG. 2C is an elevation view through A-A' of FIG. 1, showing the magnetic configuration with the shuttle regressed to the first position, where the support is in the fully deployed position.
Figure 3A:
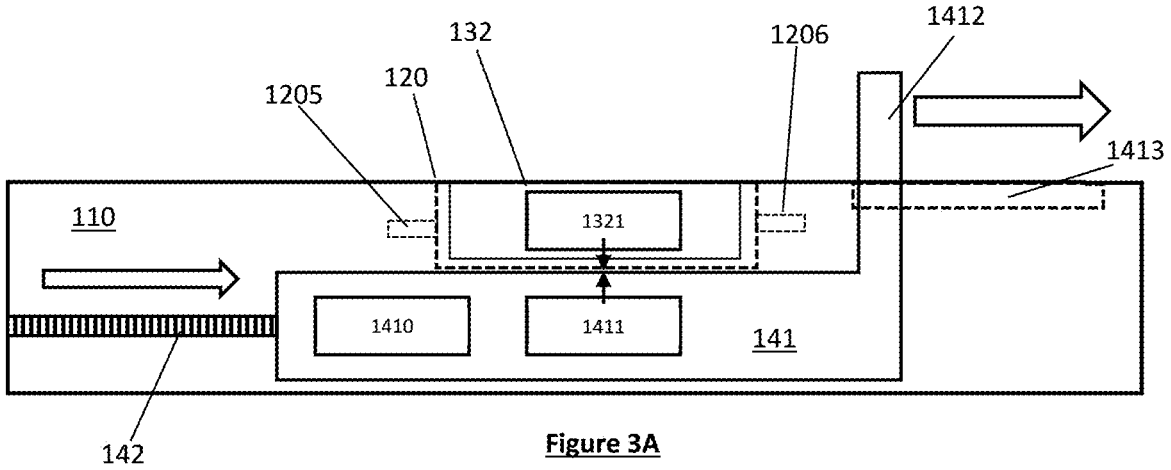
FIG. 3A is a bottom elevation view through B-B' of FIG. 1, showing the magnetic configuration with the shuttle in a first position, where the support is in an initial undeployed position.
Figure 3B:
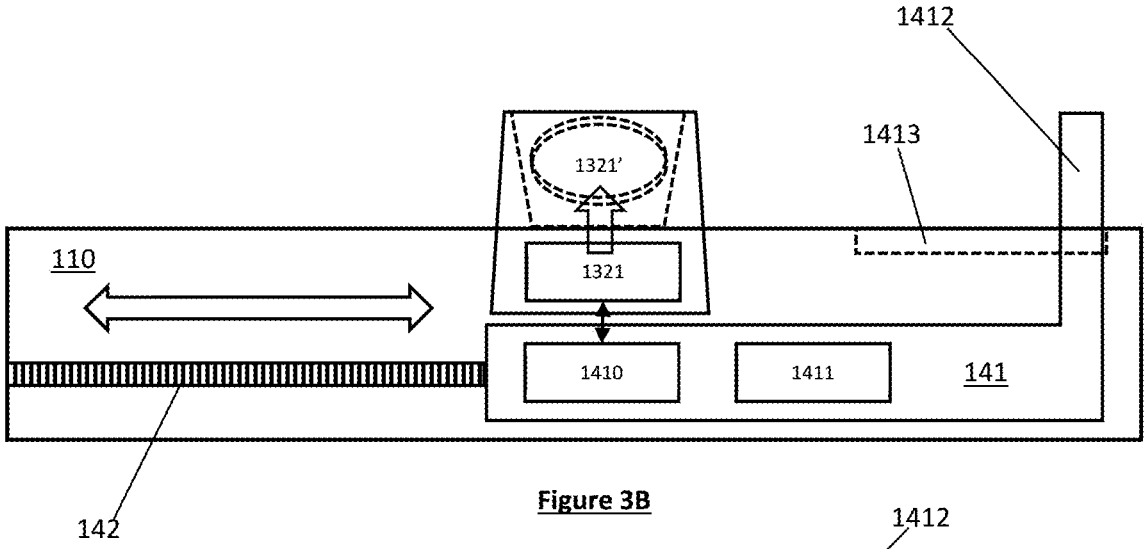
FIG. 3B is a bottom elevation view through B-B' of FIG. 1, showing the magnetic configuration with the shuttle in a second position, where the support is midway through deployment.
Figure 3C:
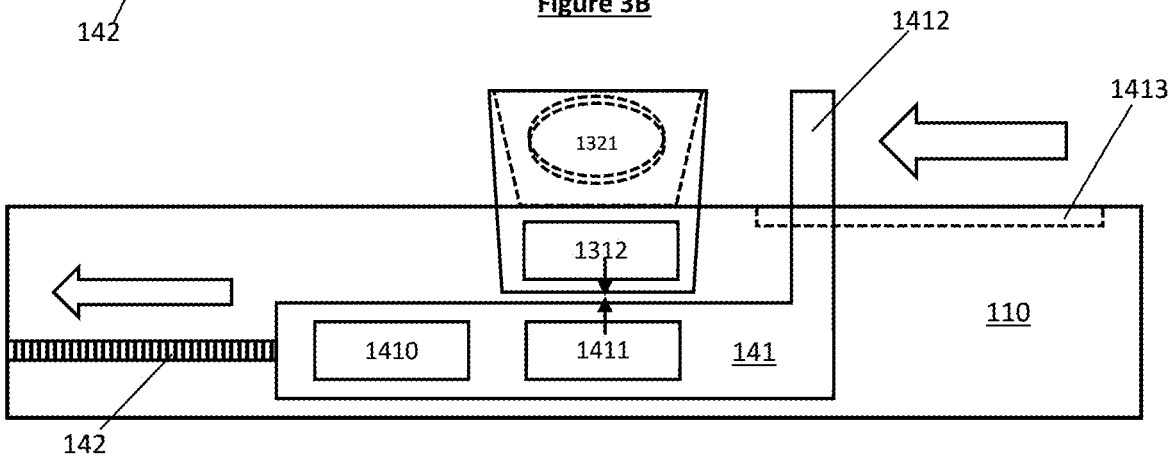
FIG. 3C is a bottom elevation view through B-B' of FIG. 1, showing the magnetic configuration with the shuttle regressed to the first position, where the support is in the fully deployed position.

FIGS. 2A-2C are right side elevation views through section A-A' of FIG. 1, and FIG. 3A-3C are bottom elevation views through section B-B' of FIG. 1. Together, these sets of Figures illustrate deployment of the deployable stand. In the undeployed position shown in FIG. 2A, magnets 1321 and 1411 are aligned. Since the south pole of magnet 1411 is disposed directly below and in proximity to the north pole of 1321, this results in magnets 1411 and 1321 exerting an attractive force which maintains deployable stand 130 in an undeployed position shown in FIG. 2A. By moving the shuttle actuating lever 1412 to the right in the shuttle actuating lever slot 1413 as shown in FIG. 1, this causes magnet 1410 to be brought under magnet 1321 when the shuttle is in a second position. Since the north pole of magnet 1410 is located facing upward, and magnet 1321 has north pole facing downward, these magnets repel each other, which causes the middle panel to displace outwardly and downwardly relative to upper channel 120.

Figure 4:
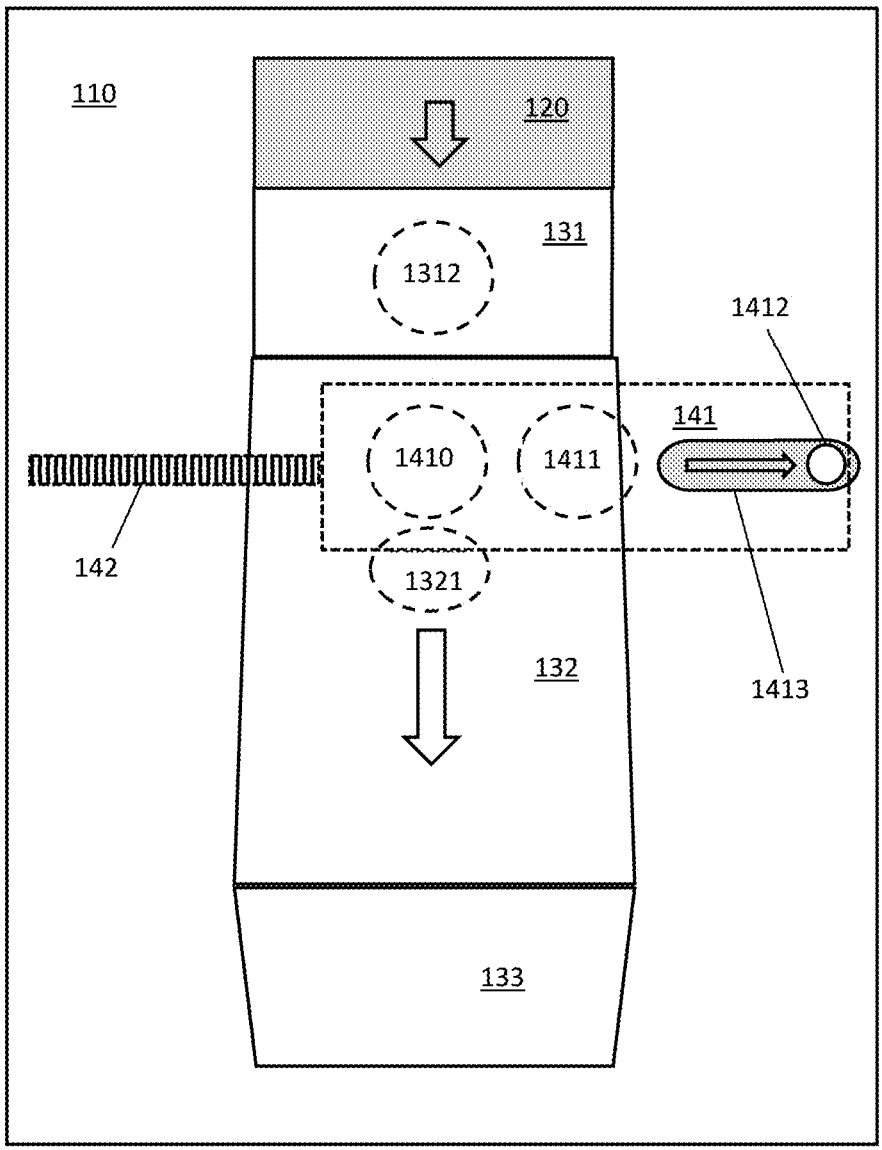
FIG. 4 is a plan view showing the shuttle in a second position, illustrating the support midway through deployment.
Figure 5:
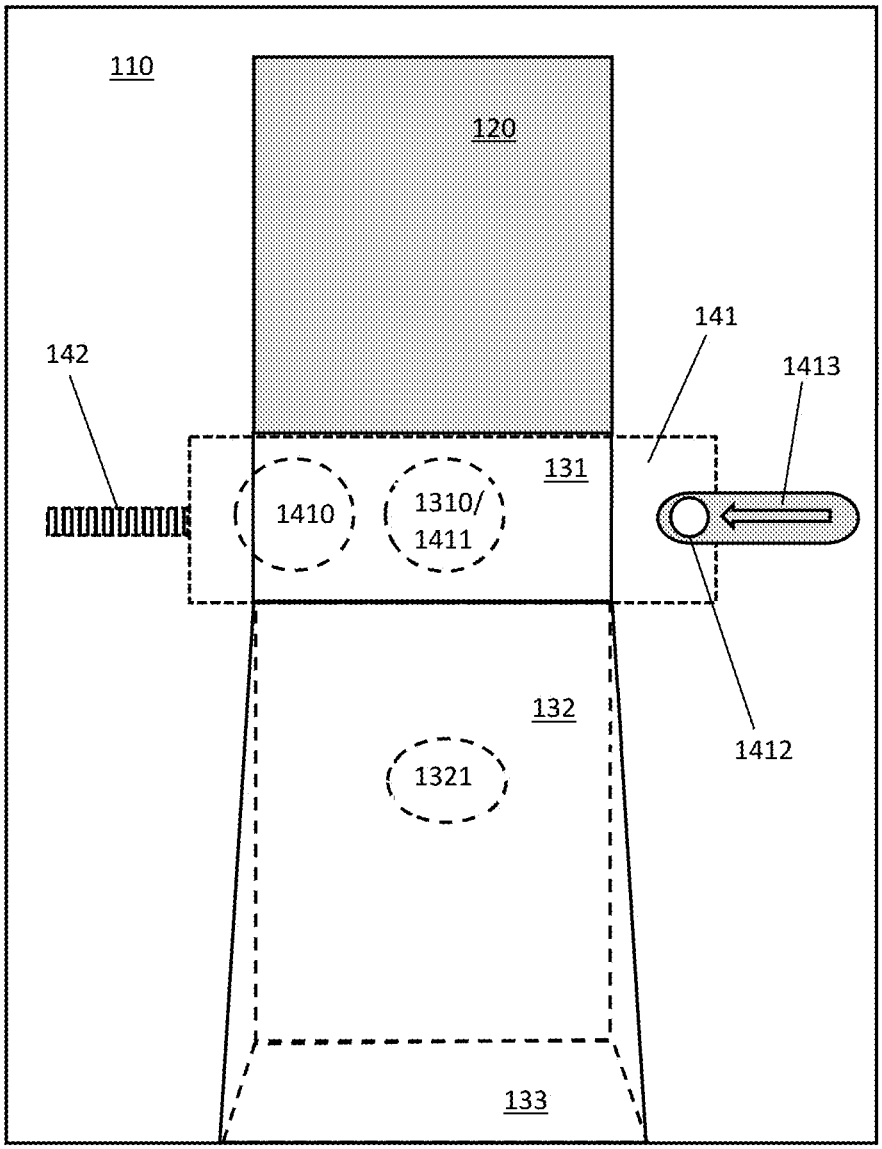
FIG. 5 is a plan view showing the shuttle regressed to the first position, illustrating the support in the fully deployed position.

Upper panel 131 simultaneously slides downward in upper channel 120, being constrained by side tabs 1310, 1311 in side tab channels 1205, 1206. When shuttle actuating lever 1412 is released, spring 142 exerts a force on the opposite side of shuttle 141 which causes shuttle 141 to return to the original position. In this original position, magnet 1411 is in proximity with magnet 1312 located in upper panel 131. Magnet 1312 is oriented so that magnet 1411 exerts an attractive force on magnet 1312, which results in upper panel 131 being held firmly in the position shown in FIG. 2C, with the deployable stand 130 in the fully deployed position. FIGS. 4 and 5 illustrate the deployment of the deployable stand in plan view.

Figure 6:
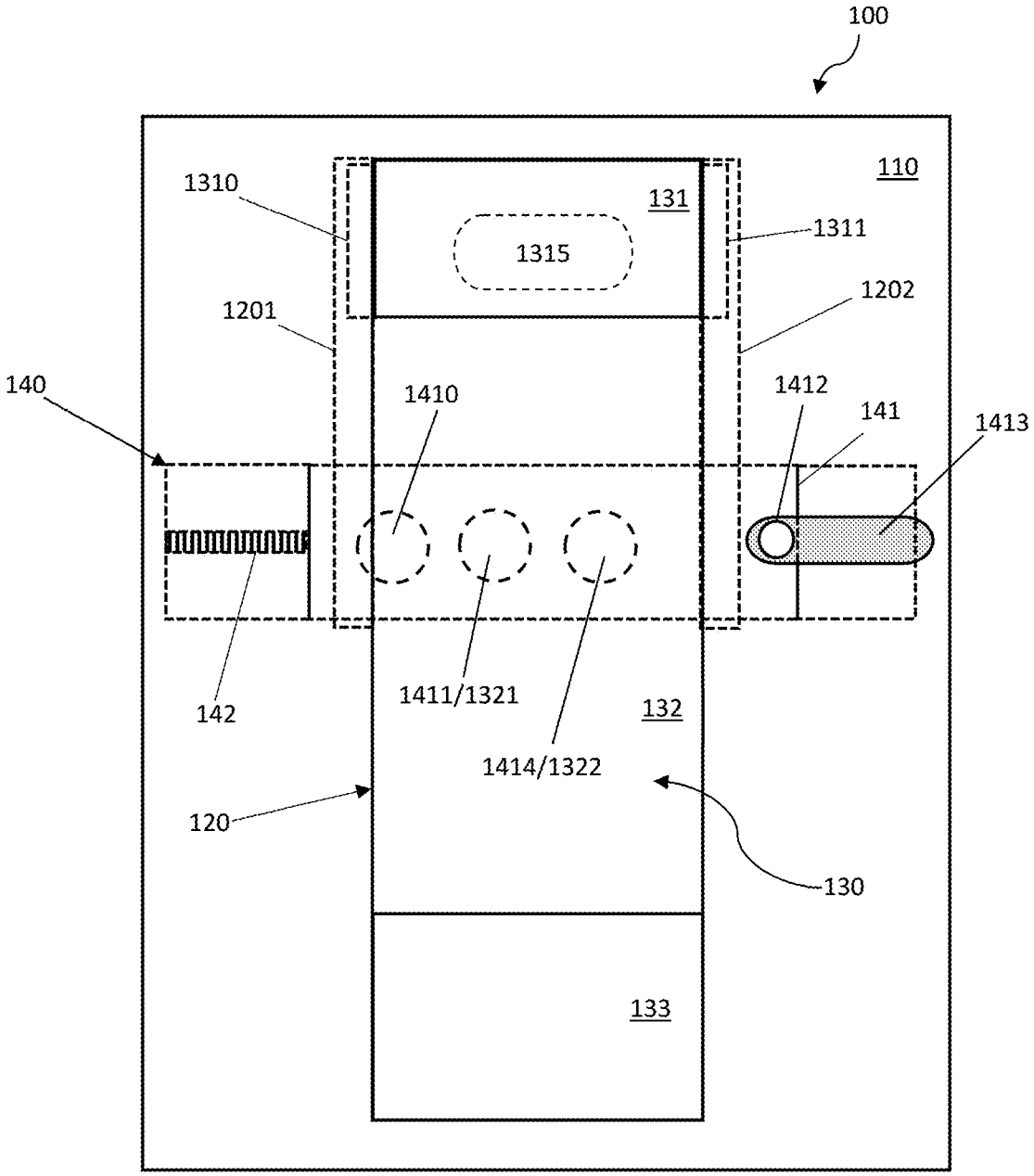
FIG. 6 is a plan view of an alternative embodiment, incorporating a third magnet in the shuttle, a second magnet in the middle panel, and a temporary magnet in the upper panel of the support in lieu of a permanent magnet in the upper panel.
Figure 7A:
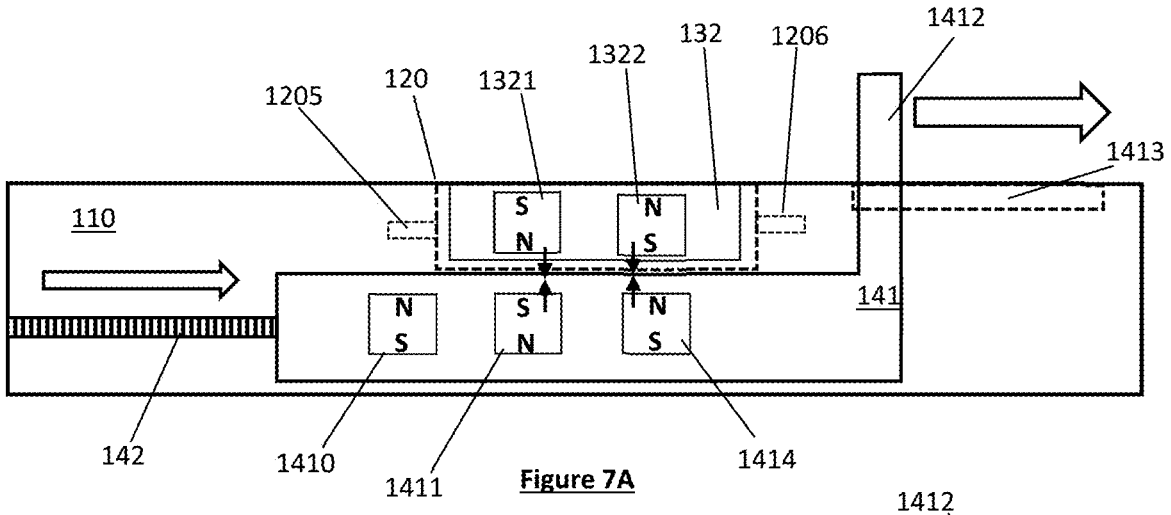
FIG. 7A is a bottom elevation view of the alternative embodiment shown in FIG. 6, showing the magnetic configuration with the shuttle in a first position, where the support is in an initial undeployed position.
Figure 7B:
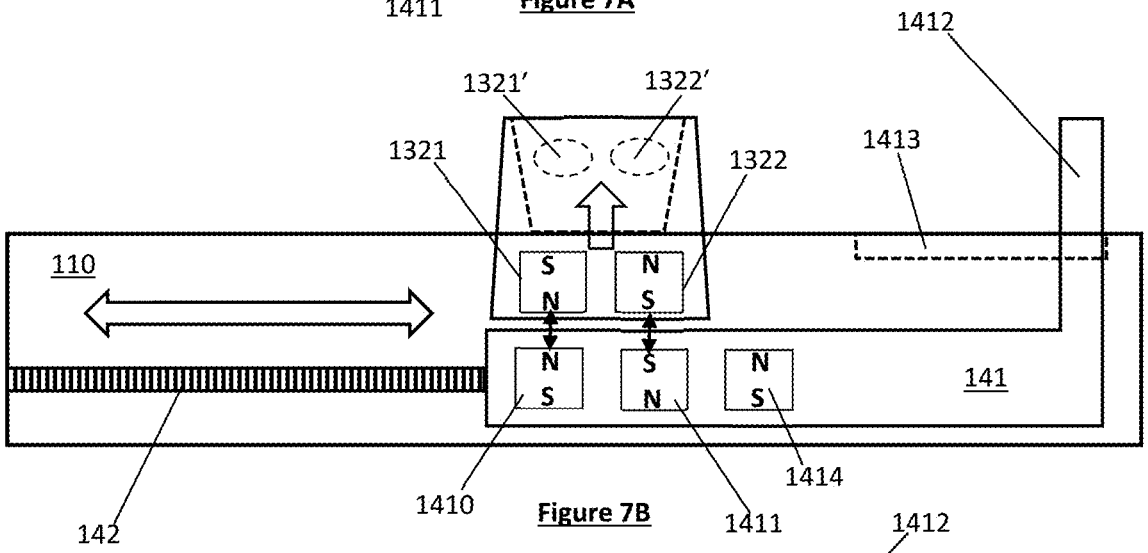
FIG. 7B is a bottom elevation view of the alternative embodiment shown in FIG. 6, showing the magnetic configuration with the shuttle in a second position, where the support is midway through deployment.
Figure 7C:
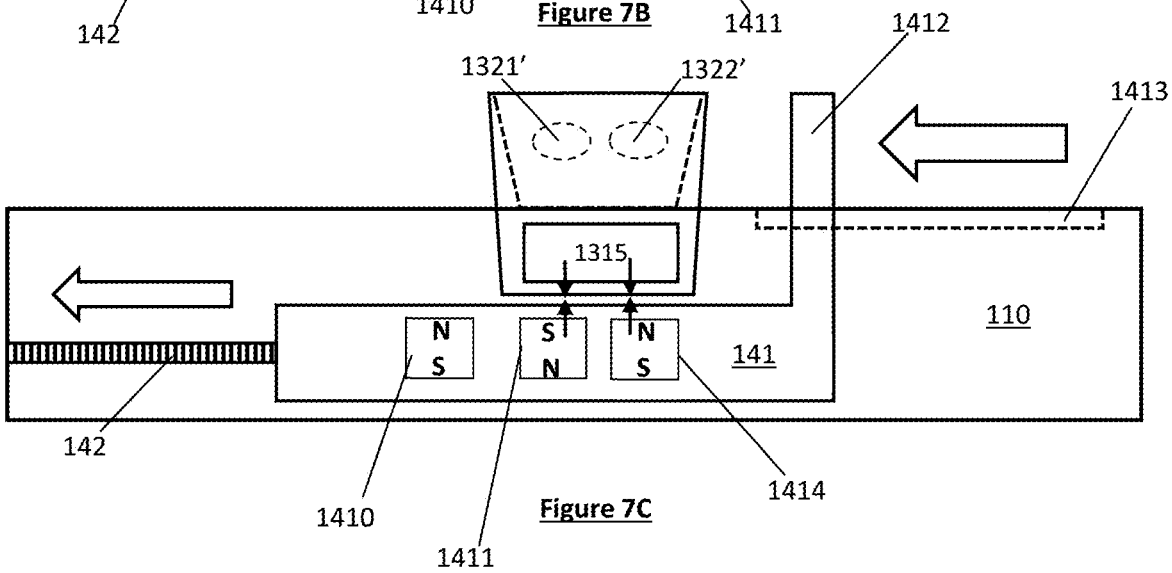
FIG. 7C is a bottom elevation view of the alternative embodiment shown in FIG. 6, showing the magnetic configuration with the shuttle regressed to the first position, where the support is in the fully deployed position.

An alternative embodiment is illustrated in plan view in FIG. 6. The overall configuration is identical to that shown in FIG. 1, with the exception that upper panel 131 incorporates a temporary magnet 1315 which is a strip of ferrous material embedded in upper panel 131 and there is an additional magnet 1414 in the shuttle and an additional magnet 1322 in the middle panel 132. FIGS. 7A through 7C illustrate the orientation of the magnets 1321, 1322 in the middle panel 132 and magnets 1410, 1411 and 1414 in the shuttle 141. Note that in the undeployed position illustrated in FIG. 7A, magnets 1321, 1322 in middle panel 132 are oriented so that they attract magnets 1411, 1414 in shuttle 141. When shuttle 141 is moved to the second position shown in FIG. 7B, magnets 1410 and 1411 are now located below magnets 1321, 1322, and the magnetic orientation is such that a repulsive force is generated, which causes middle panel 132 to move upwardly away from upper channel 120 and for upper panel to slide downward in upper channel 120 until temporary magnet 1315 is close enough so that, when shuttle 141 returns to its original position under force generated by spring 142, magnets 1411 and 1414 exert an attractive force on temporary magnet 1315, causing the deployable stand 130 to be held magnetically in the deployed position.

The embodiments above illustrate the general concept of having magnets employed in a shuttle 141 that is located in a channel disposed below a segmented deployable stand that also contains embedded magnets in one or more segments. The geometry of the channels in the embodiments illustrated above are not the exclusive configuration, and it is anticipated that, for example, the channels may not be disposed orthogonally. The overall concept involves mechanically shifting the polarity of magnets in a given geometric configuration to generate successive changes in magnetic force exerted on a corresponding magnet located in a nearby movable member. As referenced above, variations in the specific configuration of certain components commonly known to the art, such as the hinges joining the panels comprising the deployable stand, and the spring used with the shuttle, are also contemplated by these embodiments. The chassis 110 is constructed on one embodiment of a material such as polycarbonate (PC) overmolded with thermoplastic polyurethane (TPU), although other embodiments using acrylonitrile butadiene styrene (ABS), nylon, glass-filled plastics, and fiberglass may also be used, individually or in combination, as a base structural material. For the outer coverings, TPU, silicon, or other injection-moldable soft resins are contemplated for use. Permanent magnets are typically made of neodymium. Liner material used to cover the support mechanism are typically comprised of natural or synthetic microfibers (e.g. nylon).

While this invention has been described in conjunction with the specific embodiments outlined above, it is evident that many alternatives, modifications, and variations will be apparent to those skilled in the art. Indeed, the disclosure set forth herein includes all possible combinations of the particular features set forth above, whether specifically disclosed herein or not. For example, where a particular feature is disclosed in the context of a particular aspect, arrangement, configuration, or embodiment, that feature can also be used, to the extent possible, in combination with and/or in the context of other particular aspects, arrangements, configurations, and embodiments of the invention, and in the invention generally. Moreover, the disclosure set forth herein includes the mirror image, i.e., mirror configuration, taken from any perspective of any drawing or other configuration shown or described herein. Accordingly, the preferred embodiments of the invention as set forth above are intended to be illustrative, not limiting. Various changes may be made without departing from the spirit and scope of the inventions as defined in the following claims. In addition, it is noted that citation or identification of any document in this application is not an admission that such document is available as prior art to the present invention.

What is claimed is:

1. A method of magnetically actuating a supporting apparatus for an article between retracted and deployed states, the method comprising the steps of:

disposing a first magnet oriented in a first direction in a first portion of the supporting apparatus, wherein the first portion is constrained to translate linearly in a first channel between a retracted position and a deployed position;

disposing a second magnet oriented in a first direction in a second portion of the supporting apparatus, wherein the second portion of the supporting apparatus is hingedly connected to the first portion, wherein the second portion is adapted to translate upwardly out of the first channel when the first portion is not in the retracted position;

disposing, in a shuttle disposed in a second channel, a third magnet oriented in a first direction and a fourth magnet oriented in a second direction; and disposing the first channel above the second channel, such that a top portion of the shuttle is congruent with a bottom of the first channel;

wherein the shuttle is capable of translating through a deployment and retraction cycle comprising: a first position wherein the third magnet is disposed in register with the bottom of the first channel in proximity with the second magnet, to a second position wherein the fourth magnet is disposed in register with the bottom of the first channel in proximity with the second magnet, to a third position where the third magnet is disposed in register with the bottom of the first channel in proximity with the first magnet.

2. The method according to claim 1, wherein the second channel is disposed orthogonally to the first channel.

* * * * *